United States Patent [19]

Bergero et al.

[11] Patent Number: 5,004,990

[45] Date of Patent: Apr. 2, 1991

[54] MICROWAVE LOAD IN SMALL-LENGTH OVERSIZED WAVEGUIDE FORM

[75] Inventors: Jean-Pierre Bergero, Limeil Brevannes; Claude Couasnard, Meudon La Foret, both of France

[73] Assignee: Thomson Tubes Electroniques, Boulogne Billancourt, France

[21] Appl. No.: 436,006

[22] Filed: Nov. 13, 1989

[30] Foreign Application Priority Data

Nov. 15, 1988 [FR] France ..... 88 14800

[51] Int. Cl.[5] ..... H01P 1/26

[52] U.S. Cl. ..... 333/22 R; 333/21 R

[58] Field of Search ..... 333/22 R, 22 F

[56] References Cited

U.S. PATENT DOCUMENTS 4,593,259 6/1986 Fox et al. ..... 333/22 F 4,740,763 4/1988 Wilhelm et al. ..... 333/22 F

FOREIGN PATENT DOCUMENTS 87501 5/1985 Japan ..... 333/22 R

*Primary Examiner*—Paul Gensler

*Attorney, Agent, or Firm*—Oblon, Spivak, McClelland, Maier & Neustadt

[57] ABSTRACT

Disclosed is a microwave load in a small-length oversized waveguide form. It comprises a body in waveguide form, made of an absorbent material with both its ends open. An oversized waveguide propagating low loss microwaves that have to be attenuated is connected to the end of the load. The cross section of the interior of the body is substantially equal to or greater than the cross section of the interior of the oversized waveguide. A mode reflecting and converting device closes the end of the load.

12 Claims, 3 Drawing Sheets

MICROWAVE LOAD IN SMALL-LENGTH OVERSIZED WAVEGUIDE FORM

BACKGROUND OF THE INVENTION

1. Field of the Invention

The present invention concerns a microwave load in small-length oversized waveguide form.

2. Description of the Prior Art

The technology of millimetric or sub-millimetric high power waves is currently being developed through generators and amplifiers such as gyrotrons etc. The waveguides used are oversized so that the necessary power can be transmitted. The waveguides, which are generally circular sectioned, have diameters of more than three times and, sometimes, of more than twenty times the wavelength in the infinite free space of the guided wave.

These overdimensioned guides enable a reduction in transmission losses. This is why propagation modes producing low losses are chosen. In the case of circular waveguides, the low loss modes are of the $TE_{On}$ type (n being a whole number greater than or equal to one) and the mode $TE_{01}$ is frequently used.

In order to dissipate a part of or all the power brought into play during tests, for example, use is made of devices called matched loads which are often waveguide elements with high transmission losses, where the power gets dissipated in an absorbent material.

Owing to low transmission losses related, firstly, to the oversizing and, secondly, to the low loss mode chosen, standard loads have a very great absorbent length.

Furthermore, the loads have to absorb not only the power contained in the preferred mode but also the power contained in the unwanted modes made inevitable by the size of the overdimensioned waveguide.

If a portion of the power is not absorbed in the load, there is a risk that it will be reflected towards the oversized waveguide or generator, and this may lead to their destruction.

Existing matched loads generally consist of a waveguide made of an absorbent material which may be closed by a short-circuit at one of its ends. The other end is open, for it is by this end that the waves to be attenuated penetrate. They get propagated firstly in a overdimensioned waveguide which is connected to the input of the load. In the case of a circular waveguide, the diameter of the guide forming the load is substantially equal to or greater than that of the waveguide propagating the waves to be absorbed. The incident waves that have penetrated the load and have not been absorbed are reflected towards the input by the short-circuit and may be absorbed on their return.

The lengths of such loads for the circular mode $TE_{01}$ are very great.

At 100 GHz, a load formed by a tube with an internal diameter of 63.5 millimeters will have a length of 7 meters and, at 8 GHz, a load formed by a tube with an internal diameter of 114 millimeters will have a length of 2.50 meters.

One idea proposed to reduce these lengths was to gradually reduce the cross section of the waveguide forming the load in its rear part. The first part of the load, close to the input of the waves to be attenuated, has a constant cross section. It attenuates waves for which the high order modes have high losses and which cannot get .propagated in the zone with reduced section. The second part of the load with a gradually reduced section attenuates the low order modes which have low losses. The lengths of such loads are reduced. For example, at 100 GHz, the above-mentioned load will have a length of 3 meters and at 8 GHz, its length will be only 1.50 meters.

However, this load is accompanied by a major reduction in the maximum level of absorbable power. This reduction in performance levels varies in a ratio of 2 to 5, depending on the degree of initial oversizing. For, the increase in losses consequent to a reduction in the cross-section of the load is significant only if the reduction in the section is great. This means that a high power density gets collected in that part of the load having a greatly reduced section, and that there are risks of breakdown.

Furthermore, each absorbent material dissipates a certain quantity of power per unit of area, and this limits the absorbable power in the part of the load having a greatly reduced section.

The making of a structure with a greatly reduced section is particularly expensive.

There is another known type of load in a reduced-length waveguide form. A load in waveguide form, with a constant section, is taken and a conical or pyramid-shaped metallic element is placed inside the guide, in its rear part. This load has the same drawbacks as above and, moreover, the metallic element has a limited length for mechanical and thermal reasons.

The present invention proposes a microwave load in reduced-length, oversized waveguide form, enabling the absorption of all the power transmitted by an overdimensioned waveguide placed at its input. The costs of making a load such as this are low.

SUMMARY OF THE INVENTION

The present invention proposes a microwave load comprising a body in waveguide form with a longitudinal axis XX', made of an absorbent material having both its ends open, attenuating microwaves with low losses that are propagated in an oversized waveguide connected to the first end of the load, the cross section of the interior of the body of the load being substantially equal to or greater than that of the interior of the oversized waveguide, wherein a mode reflecting and converting device closes the second end of the load, this device being designed to convert the mode of the microwaves that have not yet been absorbed at the second end of the load into at least one mode with higher losses and to reflect these waves towards the first end of the load so that they are absorbed.

The mode reflecting and converting device converts the low loss mode of the non-absorbed incident waves into at least one mode with higher losses. The reflected waves can then be absorbed on their return, before leaving the load.

The mode reflecting and converting device is either a single piece or formed by at least two separate parts.

It may consist of a metallic part placed crosswise to the axis XX' and having, towards the interior of the load, at least one portion, offset as a recess or as a projection, so as to define at least two distinct reflecting planes. According to another possibility, it may be formed by a metallic part placed crosswise to the axis XX' and at least one sheet metal element fixed to the interior of the body of the load, crosswise to the axis XX' so as to define two distinct reflecting planes.

The load according to the invention is twice as small as standard loads. Its power performance is equal to the maximum power transmitted by an oversized waveguide having the same cross section as the interior of the body of the load.

BRIEF DESCRIPTION OF THE DRAWINGS

Other characteristics and advantages of the invention will appear from the following description illustrated by the appended drawings, of which.

DESCRIPTION OF PREFERRED EMBODIMENTS

Figure 1:
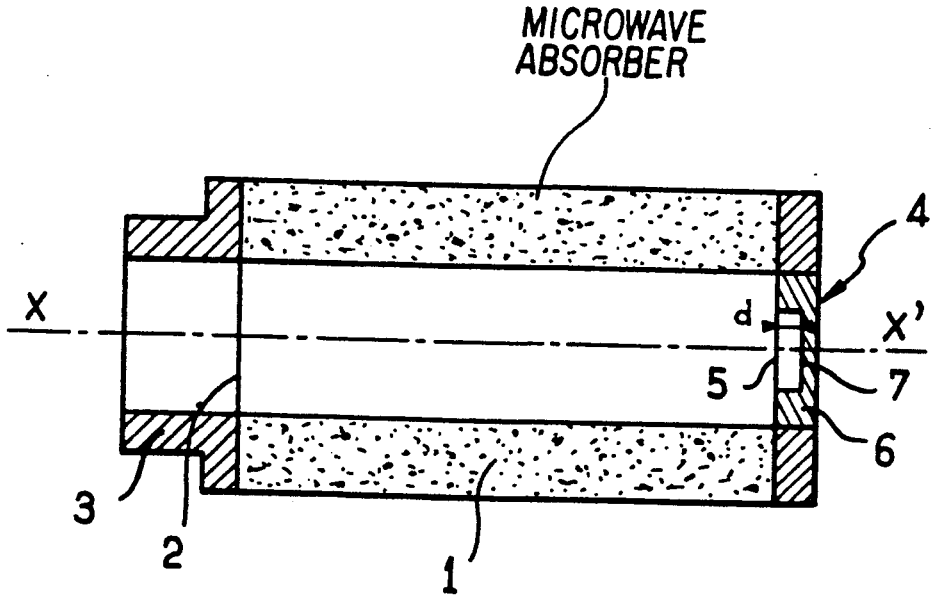
FIG. 1 shows a longitudinal sectional view of a first embodiment of a load according to the invention, the mode reflecting and converting device being a single piece.

FIG. 1 shows a longitudinal sectional view of a first embodiment of a microwave load according to the invention. It is formed essentially by a body 1, which is a waveguide section with a longitudinal axis XX', made of absorbent material, the two ends, 2 and 5, of which are open. The end 2 is located at the front of the load and the end 5 is located at the rear of the load.

The absorbent material is any material. It is possible to use, for example, a material containing silicon carbide or else water contained outside a casing made of dielectric material.

The end 2 is connected to a waveguide 3 propagating microwaves to be attenuated. The main axis of the waveguide 3 is, in this example, in the extension of the axis XX'. The microwaves to be attenuated penetrate the body 1 of the load through the end 2. The waveguide 3 is oversized and propagates microwaves at low losses. The cross section of the interior of the body 1 of the load is substantially equal, in this example, to the cross section of the interior of the oversized waveguide 3 if it is desired to have, firstly, efficient power performance and, secondly, to receive, within the load, all the modes existing in the oversized waveguide 3.

A mode reflecting and converting device 4 closes the other end 5 of the load. This device is designed, firstly, to convert the mode of the incident microwaves which are propagated along the load up to the end 5 without being absorbed and, secondly, to reflect these waves towards the end 2. The mode of the incident waves is converted so that they will be absorbed on their return before leaving the load.

The mode of the incident waves which have not been absorbed on reaching the end 5 is a mode with low losses. The mode reflecting and converting device converts this low losses mode into one or more modes with greater losses. The reflected waves can thus be absorbed.

According to this first preferred embodiment, the mode reflecting and converting device 4 is a single piece. The mode reflecting and converting device 4 is formed by a metallic part 6, generally in the form of a plate, which is fixed to the end 5 of the load. It is placed crosswise to the axis XX' so as to close the end 5 of the load. This part has, on a face oriented towards the interior of the body 1 of the load, at least one portion offset as a recess or a projection, so as create at least two distinct planes of reflection in the rear of the load. These two planes of reflections are separated by a distance d. This offset portion 7 is obtained by an abrupt variation in the external dimensions of the face oriented towards the interior of the body 1 of the load.

The microwaves that get reflected on this offset portion 7 will be phase-shifted with respect to the waves which will be reflected on the rest of the part 6. By this means, the structure of the field lines of the reflected waves is modified. The mode of the incident waves is converted into at least one mode different from the initial mode. It is not necessary for the converted mode to be very pure, nor for it to be only one mode. There are generally many propagation modes having transmission losses such that they can be propagated in oversized waveguides. The conversion into one or more high loss modes may be got by a very large number of possibilities as regards the geometry of the metallic part 6, and notably the geometry of the offset portions.

Various alternative embodiments of single-piece mode reflecting and converting devices are shown in FIGS. 2*a* to 2*g*. These examples are not restrictive. In these figures, the metallic part 6 is a disk. It closes the end 5 of the load, the body of which is then a circular waveguide. The diameter of the disk will be substantially equal to the diameter of the interior of the body of the load. The body of the load is not shown. In all these figures, the thickness of the disk varies abruptly at the offset portions.

Figure 2A:
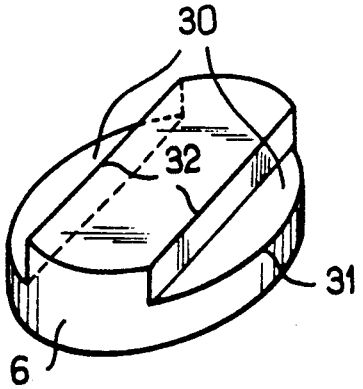
FIGS. 2*a* to 2*g* show various alternative embodiments of a mode reflecting and converting device which is a single piece, with a circular section, formed by a metallic part of which one face, oriented towards the interior of the body of the load, comprises at least one portion offset in a recess or in a projection, so as to create at least two distinct planes of reflection.

In FIG. 2*a*, the metallic part 6 has two equal indents 30, each demarcated by an arc 31 of a circle and a secant 32. The two secants are parallel.

Figure 2B:
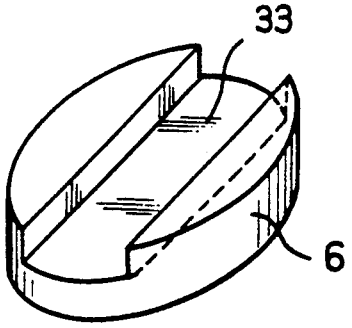

In FIG. 2*b*, the metallic part 6 has a groove 33 with parallel sides. The longitudinal axis of the groove is a diameter of the disk.

Figure 2C:
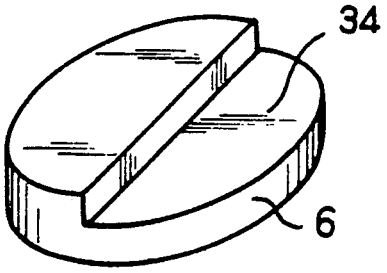

In FIG. 2*c*, the metallic part 6 has an indent 34, the surface of which is a semi-circle.

Figure 2D:
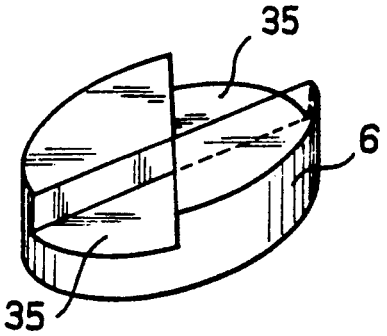

In FIG. 2*d*, the metallic part 6 has two notches 35, the surface of which is a sector of the disk.

These two notches 35 are opposite by the apex angles and are equal.

Figure 2E:
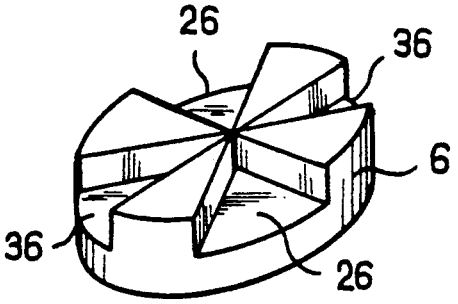

In FIG. 2*e*, the metallic part 6 has two indents 26 and two indents 36. The surface of each of the indents is a sector of the disk. The indents 36 are opposite by their apex angles and are equal. The indents 26 are opposite by their apex angles and are equal.

Figure 2F:
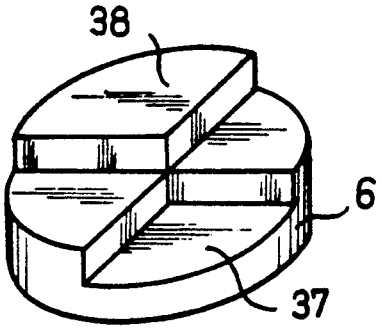

In FIG. 2*f*, the metallic part 6 has an indent 37 and a projecting portion 38 which are equal and the surface of which is a sector of the disk. This indent 37 and this projecting portion 38, although located in different planes, are opposite by their apex angles.

Figure 2G:
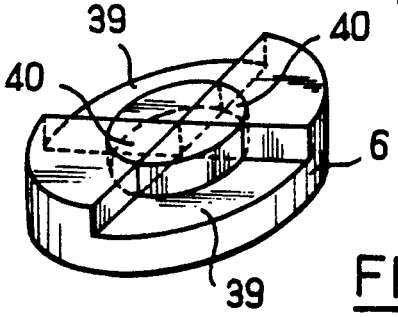

In FIG. 2*g*, the metallic part 6 has two first equal indents 39, the surface of which is a crown sector. These two equal indents are placed symmetrically with respect to a diameter of the disk. The metallic part 6 further has two second equal indents 40, the surface of which is a sector of a circle with a radius equal to the internal radius of the crown sector of the first indents 39. The second indents 40 are opposite by their apex angles. The sum of the apex angles of the second indents 40, and cf the apex angles bounded by the extensions of the sides of the crown sectors is 360 degrees.

Figure 3:
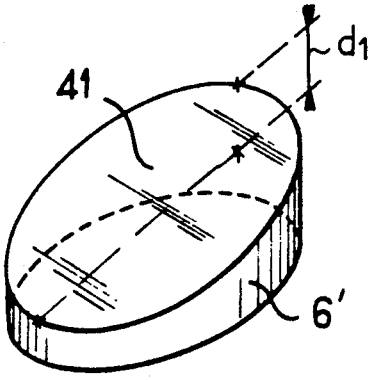
FIG. 3 shows another alternative embodiment of a mode reflecting and converting device which is a single piece, with a circular section, formed by a metallic part, of which one face, oriented towards the interior of the body of the load, is placed in an plane that is oblique to the axis XX'.

FIG. 3 shows another variant of the mode reflecting and converting device, in the form of a single piece. In this figure, the mode reflecting and converting device consists of a metallic part 6', placed crosswise to the axis XX'. This part 6' has a circular contour. A face 41 of the part 6', located towards the interior of the body of the load, is flat and oblique to the axis XX'.

Two distinct points placed on this face 41 will be offset with respect to one another, at the maximum by a distance $d_1$ measured along the axis XX'.

Microwaves that get reflected on one zone of the face 41 will be phase-shifted with respect to the waves which will get reflected on another zone of the face 41.

This oblique face 41 has an infinity of distinct reflecting zones.

This metallic part 6' has the same effect on the microwaves as the metallic part 6 described in FIG. 2*c*.

Figure 4:
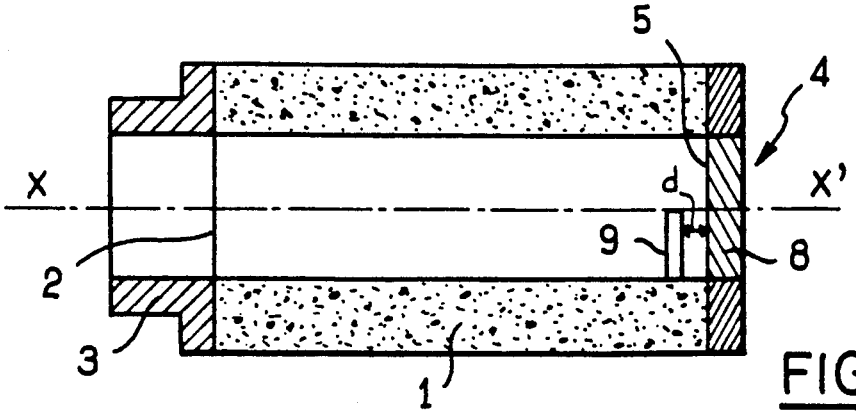
FIG. 4 shows a longitudinal sectional view of another embodiment of a load according to the invention, the mode reflecting and converting device being formed by several separate parts.

According to a second embodiment, the mode reflecting and converting device comprises several separate parts. FIG. 4 illustrates this possibility. The mode reflecting and converting device 4 has a metallic part 8, generally in plate form, fixed to the end 5 of the load. It is placed crosswise to the axis XX' so as to close the end 5 of the load. It is designed to reflect incident waves. At least one metallic element 9 is fixed to the interior of the body 1 of the load, and extends towards the interior of the load. This element is placed in a zone close to the metallic part 8, towards the rear of the load. Thus, at least two distinct planes of reflection are obtained, with a distance d between them. Preferably, this metallic element 9 will be a sheet metal plate, and will be fixed crosswise to the axis XX'. If there are several metallic elements 9, they will not be in contact with one another. This metallic element 9 is designed to reflect a portion of the incident waves towards the end 2. The incident waves that are reflected on the part 8 will be phase-shifted with respect to the waves which get reflected on the element 9. The mode of the initial waves is converted into one or more modes, different from the initial mode.

Figure 5A:
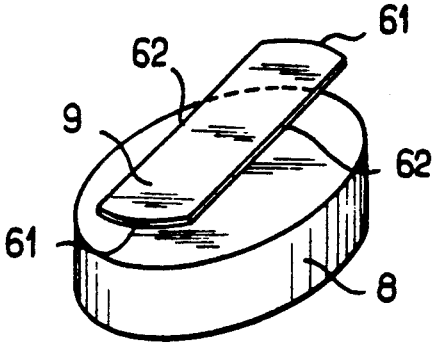
FIGS. 5*a*, 5*b*, 5*c* show various alternative embodiments of a circular sectioned mode reflecting and converting device comprising several separate parts.
Figure 5B:
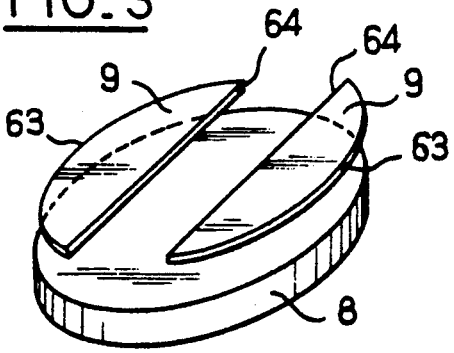
Figure 5C:
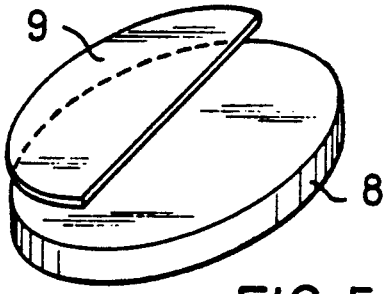

Different variants of the mode reflecting and converging devices in several separate parts are shown in FIGS. 5*a*, 5*b*, 5*c*. The metallic part 8 is a disk with the same diameter as the interior of the body of the load. The body of the load is not shown.

In FIG. 5*a*, there is only one metallic element 9. It is a sheet metal plate, two first opposite sides 61 of which are arcs of a circle with the same radius as the radius of the disk, and two other opposite sides 62 of which are parallel. This sheet metal plate is fixed to the interior of the body of the load by its sides 61 shaped like an arc of a circle. This mode reflecting and converting device is equivalent to that shown in FIG. 2*a*.

In FIG. 5*b*, there are two metallic elements 9. They are each formed by a sheet metal plate, and are equal. Their surface is demarcated by a side 63 in the shape of an arc of a circle and a straight side 64. These metallic elements 9 are fixed to the interior of the body of the load by their sides 63 having the shape of an arc of a circle, so that their straight sides 64 are parallel. This device is equivalent to the one shown in FIG. 2*b*.

In FIG. 5*c*, there is only one metallic element 9. It is formed by a semi-circular sheet metal plate, and is fixed to the inside of the body of the load by its semi-circular side. This device is equivalent to those shown in FIGS. 2*c* and 3.

The mode reflecting and converting device may also be formed by a known type of mode converter, ended by a short-circuit plate.

The waveguide section forming the body 1 of the load may have any internal cross section. It is enough for it to be oversized. In this case, the mode reflecting and converting device may have a shape that is matched accordingly.

Figure 6A:
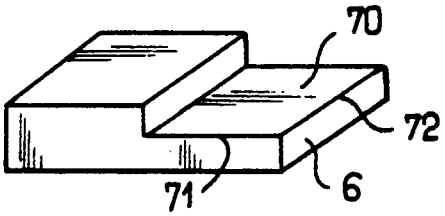
FIGS. 6*a*, 6*b* and 6*c* show various alternative embodiments of a rectangular sectioned mode reflecting and converting device which is a single piece.
Figure 6B:
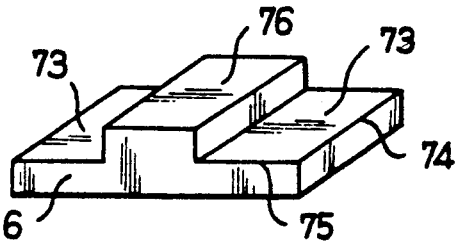
Figure 6C:
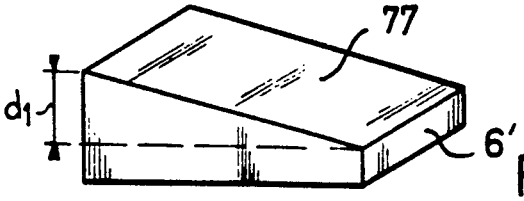

FIGS. 6*a*, 6*b*, 6*c* show various alternative embodiments of single-piece mode reflecting and converting devices formed by rectangular-sectioned metallic parts 6 or 6'. These metallic parts are plates in the FIGS. 6*a*, 6*b*. The body of the load will be a rectangular waveguide. It is not shown.

In FIG. 6*a*, the metallic part 6 has a rectangular or square indent 70 with one of its dimensions, 71, being smaller than the length of the rectangle and its other dimension, 72, being the width of the rectangle. The thickness of the metallic part 6 varies abruptly a the indent 70.

In FIG. 6*b*, the metallic part 6 has two equal rectangular or square indents 73. One of the dimensions 74 of these indents 73 is the width of the rectangle and the other dimension 75 is smaller than half the length of the rectangle. These two indents 73 are located on either side of a portion 76 which is not offset. The thickness of the metallic part 6 varies abruptly at the indents 73.

In FIG. 6*c*, the metallic part 6', having a rectangular contour, has a face 77 located towards the interior of the body of the load. This face 77 is flat and oblique to the longitudinal axis XX' of the body of the load.

When the mode reflecting and converting device, whether it is a single piece or not, has a simple shape and includes at least two reflection planes, the optimal distance d between these two planes is substantiallY equal to an odd number of quarter wavelengths guided in the body of the load.

When the mode reflecting and converting device, whether it is a single piece or not, has a more complicated shape with recessed parts as in FIG. 2*g*, and when it has at least two reflection planes, the distance d between these two planes is substantially equal to an odd number of quarter wavelengths guided in the recessed parts.

When the mode reflecting and converting device is a single piece, and when its face oriented towards the interior of the body of the load is oblique, the optimal distance d is substantially equal to an odd number of half wavelengths guided in tne body of the load. This case is shown in FIGS. 3 and 6*c*.

As a precautionary measure, the mode reflecting and converting device will have only rounded corners, as is the practice with devices subjected to high levels of power.

Several mode reflecting and converting devices, as described in FIGS. 2*a* to 2*f*, 3, 5*a* to 5*c* have been tried out in a load formed by a circular waveguide section, with a diameter of 114 millimeters and a length of 600 millimeters at the frequency of 8 GHz. The incident modes $TE_{01}$, $TE_{02}$, $TE_{51}$ have been tested. The distance between the reflection planes was 9.5 millimeters, namely a quarter of the guided wavelength of the $TE_{01}$ mode at 8 GHz. The standing wave ratio measured was smaller than 1.10. With different distances between the planes of reflection, for example of the order of 8.5 millimeters, the standing wave ratio then goes up to 1.20 but, even in this configuration, the invention gives an improvement over the prior art.

The examples given are not restrictive. Other structures of mode reflecting and converting devices may be envisaged without going beyond the scope of the invention.

What is claimed is:

1. A microwave load for attenuation of waves with low losses that are propagated in an oversized waveguide comprising:

a body of absorbent material having a longitudinal axis and an interior cross section substantially equal to or larger than an interior cross section of the oversized waveguide, the body forming a waveguide section and having a first open end connected to the oversized waveguide and a second open end; and a mode reflecting and converting device closing the second end of the body and having a part thereof which is oriented substantially transversely to the longitudinal axis, the part facing an interior of the body;

wherein the part comprises at least one offset portion forming one of a recess and projection defining at least two distinct reflecting planes for converting a mode of waves located at the second end of the body into at least one mode of higher losses and for reflecting converted waves towards the first end for absorption.

2. A microwave load according to claim 1, wherein the mode reflecting and converting device is a single metallic piece.

3. A microwave load according to claim 1, wherein external dimensions of the part oriented towards the interior of the body vary abruptly.

4. A microwave load according to claim 1, wherein the mode reflecting and converting device comprises at least first and second separate elements.

5. A microwave load according to claim 4, wherein the first element is a metallic piece located transversely to the longitudinal axis at the second end of the body, the second element being a plurality of metallic pieces, fixed to the interior of the body, and positioned transversely to the longitudinal axis, the first and the second elements defining at least two distinct reflecting planes.

6. A microwave load according to claim 5, wherein the metallic pieces of the second element are metal sheets.

7. A microwave load according to either of claims 5 or 6, wherein the metallic pieces of the second element have no contact with one another.

8. A microwave load according to claim 4, wherein the mode reflecting and converting device is a mode converter ended by a short-circuit.

9. A microwave load according to claim 1, wherein the at least two distinct reflecting planes include two successive reflecting planes which are spaced by a distance substantially equal to an odd number of quarter wavelengths of the waves to be attenuated.

10. A microwave load for attenuation of waves with low losses that are propagated in an oversized waveguide comprising:

a body of absorbent material having a longitudinal axis and an interior cross section substantially equal to or larger than an interior cross section of the oversized waveguide, the body forming a waveguide section and having a first open end connected to the oversized waveguide and a second open end; and a mode reflecting and converting device closing the second end of the body and having a part thereof which is oriented substantially transversely to the longitudinal axis, the part facing an interior of the body;

wherein the part has a plenum, flat, reflective face positioned obliquely to the longitudinal axis for converting a mode of waves located at the second end of the body into at least one mode of higher losses and for reflecting converted waves towards the first end for absorption.

11. A microwave load according to claim 10, wherein the mode reflecting and converting device is a metallic single piece.

12. A microwave load according to claim 10, wherein two distinct points, located on the part, are offset with respect to each other, along the longitudinal axis, by a distance substantially equal to an odd number of half wavelengths of the waves to be attenuated.

* * * * *